US012098021B2

(12) United States Patent
Allen et al.

(10) Patent No.: US 12,098,021 B2
(45) Date of Patent: Sep. 24, 2024

(54) CONCRETE TANK

(71) Applicant: Dutchland, Inc., Gap, PA (US)

(72) Inventors: Joshua C. Allen, Lititz, PA (US); Kenneth W. Sullivan, Gap, PA (US); Theodore J. Smulski, Wilmington, DE (US)

(73) Assignees: Dutchland, LLC, Wilmington, DE (US); Sound Point Agency LLC, New York, NY (US)

( * ) Notice: Subject to any disclaimer, the term of this patent is extended or adjusted under 35 U.S.C. 154(b) by 0 days.

(21) Appl. No.: 17/579,298

(22) Filed: Jan. 19, 2022

(65) Prior Publication Data

US 2023/0227252 A1 Jul. 20, 2023

(51) Int. Cl.

| | |
|---|---|
| ***B65D 90/10*** | (2006.01) |
| ***B65D 88/08*** | (2006.01) |
| ***B65D 90/02*** | (2019.01) |

(52) U.S. Cl.
CPC ..... *B65D 90/10* (2013.01); *B65D 88/08* (2013.01); *B65D 90/023* (2013.01)

(58) Field of Classification Search
CPC ..... B65D 90/10; B65D 88/08; B65D 90/023; E04B 1/16; E04B 1/161; E04B 1/162; E04B 1/163; E04B 7/18; E04H 7/18; E04H 7/26
See application file for complete search history.

(56) References Cited

U.S. PATENT DOCUMENTS

| | | | | |
|---|---|---|---|---|
| 3,161,703 | A | 12/1964 | Watson | |
| 3,824,751 | A * | 7/1974 | Shelander | E04H 7/20 52/223.3 |
| 3,898,162 | A | 8/1975 | Carlson et al. | |
| 3,914,077 | A * | 10/1975 | Lodes | E04B 1/166 264/45.2 |
| 3,963,144 | A * | 6/1976 | Berwald | B65D 88/54 220/725 |
| 4,076,777 | A | 2/1978 | Petrovitch | |
| 4,102,956 | A * | 7/1978 | Heifetz | E04B 1/169 264/32 |
| 4,372,733 | A * | 2/1983 | Tinning | E04G 11/34 264/32 |

(Continued)

FOREIGN PATENT DOCUMENTS

| | | | |
|---|---|---|---|
| CN | 200320124240.X | Y | 1/2005 |
| CN | 105544615 | A | 5/2016 |

(Continued)

OTHER PUBLICATIONS

Figure 3 (A) Hinged dome-wall connection; (B) separate dome—wall connection, dated—Copyright 2020, American Water Works Association, 1 page.

*Primary Examiner* — Kareen K Thomas
(74) *Attorney, Agent, or Firm* — Barley Snyder

(57) ABSTRACT

A concrete tank includes a dome roof formed of concrete at least partially cast in place and a lid. The dome roof has an access opening extending through the dome roof in a vertical direction. The lid is positioned to cover the access opening with a portion of an inner lid surface overlapping a portion of an outer dome roof surface along the vertical direction. A lid bearing element is disposed between the inner lid surface and the outer dome roof surface along the vertical direction.

17 Claims, 6 Drawing Sheets

(56) References Cited

U.S. PATENT DOCUMENTS

| | | | | | |
|---|---|---|---|---|---|
| 5,094,044 | A * | 3/1992 | Dykmans | E04B 7/08 | 427/508 |
| 5,408,793 | A * | 4/1995 | Dykmans | E04B 1/168 | 52/80.1 |
| 5,675,941 | A * | 10/1997 | Dykmans | E04B 1/168 | 52/80.1 |
| 5,881,530 | A * | 3/1999 | Dykmans | B65D 88/34 | 52/81.6 |
| 8,191,318 | B2 * | 6/2012 | Kitagawa | E04B 1/3211 | 52/80.1 |
| 8,684,220 | B2 * | 4/2014 | Harvey | E04H 7/20 | 52/223.3 |
| 9,275,208 | B2 * | 3/2016 | Protopapas | G06F 21/31 | |

FOREIGN PATENT DOCUMENTS

| | | | |
|---|---|---|---|
| CN | 205205872 | U | 5/2016 |
| DE | 32 42 570 | C2 | 8/1993 |

* cited by examiner

CONCRETE TANK

FIELD OF THE INVENTION

The present invention relates to a tank and, more particularly, to a concrete tank having a dome roof.

BACKGROUND

In concrete tank construction, large equipment such as formwork, shoring, and a manlift is required to support the casting of a dome roof onto the walls of the tank. The equipment, however, must be removed from an interior of the tank after casting of the dome roof and formation of the dome roof is complete.

Existing openings in walls of the tank act as manways and are approximately 24" in diameter; these existing openings are not sufficiently large to remove the equipment used in the dome roof construction. Moreover, increasing the size of the openings in the walls would compromise the structural integrity of the tank.

SUMMARY

A concrete tank includes a dome roof formed of concrete at least partially cast in place and a lid. The dome roof has an access opening extending through the dome roof in a vertical direction. The lid is positioned to cover the access opening with a portion of an inner lid surface overlapping a portion of an outer dome roof surface along the vertical direction. A lid bearing element is disposed between the inner lid surface and the outer dome roof surface along the vertical direction.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
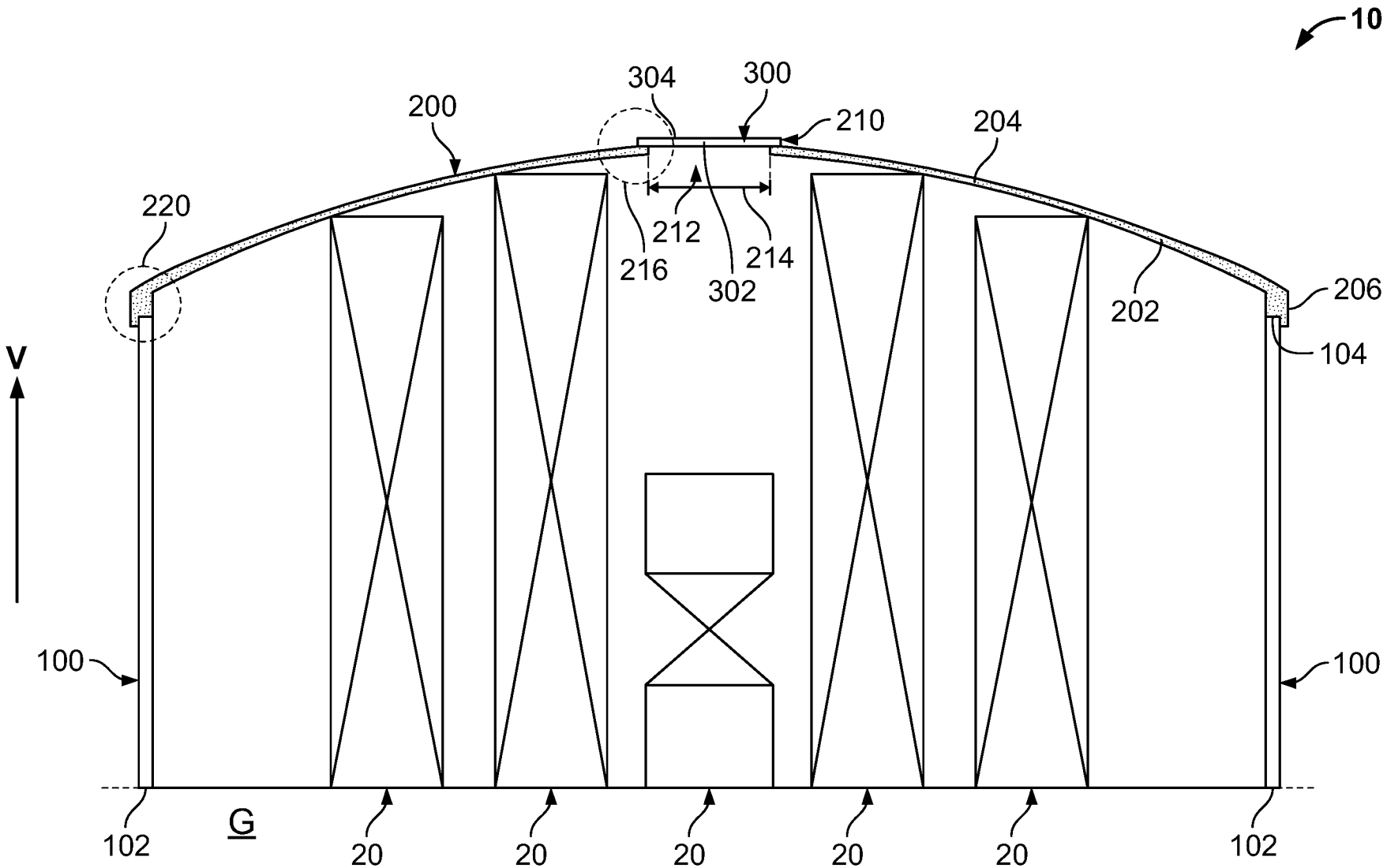
FIG. 1 is a sectional side view of a concrete tank according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will convey the concept of the disclosure to those skilled in the art. In some of the drawings, like reference numerals may be omitted for some of multiple like elements in order to maintain clarity of the drawings.

A concrete tank 10 according to an embodiment is shown in FIG. 1. The concrete tank 10 includes a wall 100, a dome roof 200 disposed on and supported by the wall 100, and a lid 300 disposed on and supported by the dome roof 200. A method of constructing the concrete tank 10 and the elements of the concrete tank 10 will be described in conjunction with one another in detail below.

The wall 100, as shown in FIG. 1, has a ground end 102 disposed on a ground G on which the concrete tank 10 stands and a top end 104 opposite the ground end 102 in a vertical direction V. The wall 100 is formed of precast concrete that is cast off site or otherwise not in its final position and shipped and/or moved to the final position on the ground G shown in FIG. 1. The wall 100, in an embodiment, is formed of a plurality of wall pieces that are each precast from concrete and assembled together to form the wall as shown in FIG. 1. In another embodiment, the wall 100 can be cast in place.

The dome roof 200 is formed of a concrete material and, in an embodiment of constructing the concrete tank 10, the dome roof 200 is at least partially cast in place on the wall 100. In an embodiment, the dome roof 200 is entirely cast in place on the wall 100. The wall 100 is positioned on the ground G prior to casting the dome roof 200 and supports the dome roof 200. An equipment 20 shown in FIG. 1 used to cast the dome roof 200 in place on the wall 100 includes, for example, formwork, shoring, and a manlift; the equipment 20 is shown schematically in FIG. 1 and can be any type of equipment 20 that is able to cast the dome roof 200 in place and meets the size requirements of the equipment 20 described herein.

In the process of constructing the concrete tank 10, in an embodiment, the wall 100 of precast concrete is erected around the equipment 20 to allow the equipment 20 to be used in casting the dome roof 200 without passing the equipment 20 through the wall 100. In another embodiment, the equipment 20 can be lifted and placed within the wall 100 after the wall 100 is erected. The equipment 20 is positioned within the wall 100 to support the concrete material as it cures to form the dome roof 200 in position as shown in FIG. 1.

Figure 2:
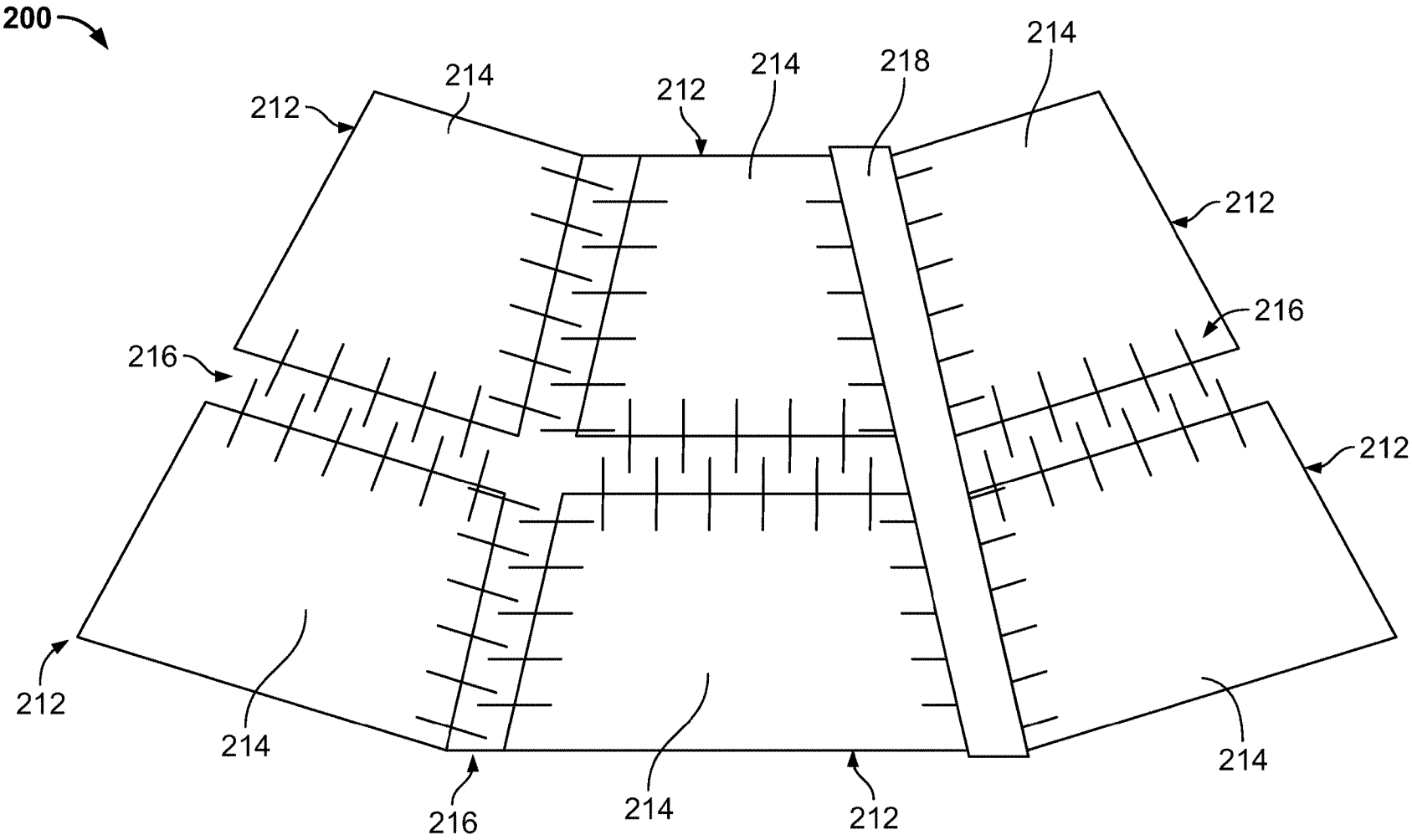
FIG. 2 is a schematic plan view of a section of a dome roof according to an embodiment.

A section of a dome roof 200 according to another embodiment, for example an angular segment of a circumference of the dome roof 200, is shown in a plan view in FIG. 2. In the embodiment shown in FIG. 2, the dome roof 200 is formed of a plurality of precast sections 212 that are secured together by a plurality of closure strips 218. The precast sections 212 each have a concrete panel 214 and a plurality of reinforcement elements 216 protruding from the concrete panel 214. The precast sections 212 are formed of precast concrete with the reinforcement elements 216 embedded; the precast sections 212 are cast off site or otherwise not in a final position and shipped and/or moved to the final position on the wall 100. The reinforcement elements 216 are, for example, rebar or any other type of reinforcement used in precast concrete.

The dome roof 200 according to the embodiment of FIG. 2 is only partially cast in place on the wall 100. To construct the dome roof 200 in the embodiment of FIG. 2, the precast sections 212 are first positioned on and supported by the wall 100 and the equipment 20. When the precast sections 212 are initially placed, the reinforcement elements 216 protruding from adjacent concrete panels 214 overlap or are positioned adjacent to one another. The closure strips 218 are then formed by pouring uncured concrete between the adjacent concrete panels 214 and over the reinforcement elements 216. The closure strips 218 are cast in place and cure to complete the dome roof 200. One closure strip 218 is shown formed in FIG. 2 while the remainder of the reinforcement elements 216 are shown exposed for ease of understanding of the embodiment but, in the fully constructed form of the dome roof 200, all the exposed reinforcement elements 216 are secured and enclosed by one of the closure strips 218.

The segment of the dome roof 200 shown in the embodiment of FIG. 2 is formed from six precast sections 212 connected by the closure strips 218. In various embodiments, the dome roof 200 could be formed by any number of precast sections 212 that are connected by any number of closure strips 218.

The dome roof 200, as shown in FIG. 1, has an inner dome roof surface 202 and an outer dome roof surface 204 opposite the inner dome roof surface 202. The dome roof 200 has a perimeter 206 defining an outer dimension of the dome roof 200 and is domed to a central section 210 located centrally within the perimeter 206. A dome roof-to-wall connection detail 220 labeled in FIG. 1 will now be described in greater detail.

Figure 3:
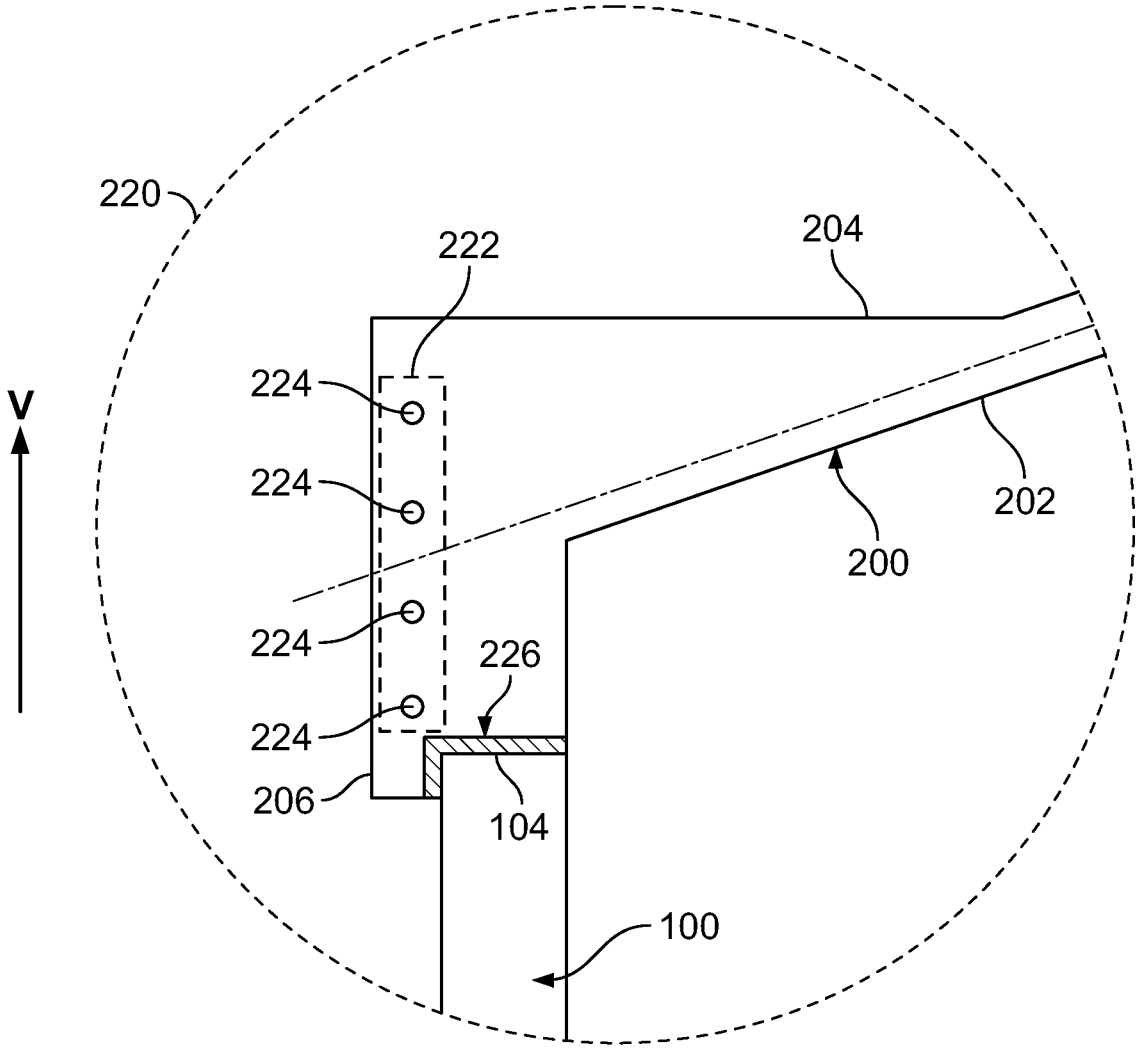
FIG. 3 is a detail sectional side view of a dome roof-to-wall connection detail of the concrete tank.

An embodiment of a connection between the dome roof 200 and the wall 100 is shown in the dome roof-to-wall connection detail 220 of FIG. 3. As shown in FIG. 3, the perimeter 206 of the dome roof 200 is disposed on the wall 100; the inner dome roof surface 202 at the perimeter 206 is disposed on top of the top end 104 of the wall 100 in the vertical direction V. In the embodiment shown in FIG. 3, the outer dome roof surface 204 extends away from the inner dome roof surface 202 to form a flat, shelf-like shape at the perimeter 206. The shape of the outer dome roof surface 204 in FIG. 3 is merely exemplary and, in other embodiments, could be a continuously curved shape that remains at a constant distance from the inner dome roof surface 202 up to the area of the perimeter 206.

In the embodiment shown in FIG. 3, a dome roof bearing element 226 is disposed between the inner dome roof surface 202 and the top end 104 of the wall 100 in the vertical direction V. The dome roof bearing element 226, in an embodiment, is formed of a resilient elastomeric material, such as rubber or neoprene. In another embodiment, the dome roof bearing element 226 is formed of a resilient elastomeric material with fibers intermixed within the resilient elastomeric material, the fibers increasing a shear strength of the material. In another embodiment, the dome roof bearing element 226 can be formed of a rigid material, such as a hard plastic or grout. In the embodiment shown in FIG. 3, the dome roof bearing element 226 is held between the dome roof 200 and the wall 100 on the top end 104 of the wall 100 by a weight of the dome roof 200.

In the embodiment shown in FIG. 3, the dome roof 200 has a tension ring 222 at the perimeter 206. The tension ring 222, in the shown embodiment, is formed from a plurality of dome roof reinforcement tendons 224 embedded within the dome roof 200; the dome roof reinforcement tendons 224 are set within the dome roof 200 while the concrete material of the dome roof 200 cures. The dome roof reinforcement tendons 224 may be formed from a steel material, or may be formed from any other type of material used for reinforcing concrete. In other embodiments, the tension ring 222 may be formed from any number of dome roof reinforcement tendons 224, and may include any number of other reinforcement elements used in concrete materials, such as reinforcement stirrups, provided that the tension ring 222 maintains a structure of the concrete tank 10 at the connection between the dome roof 200 and the wall 100.

Figure 4:
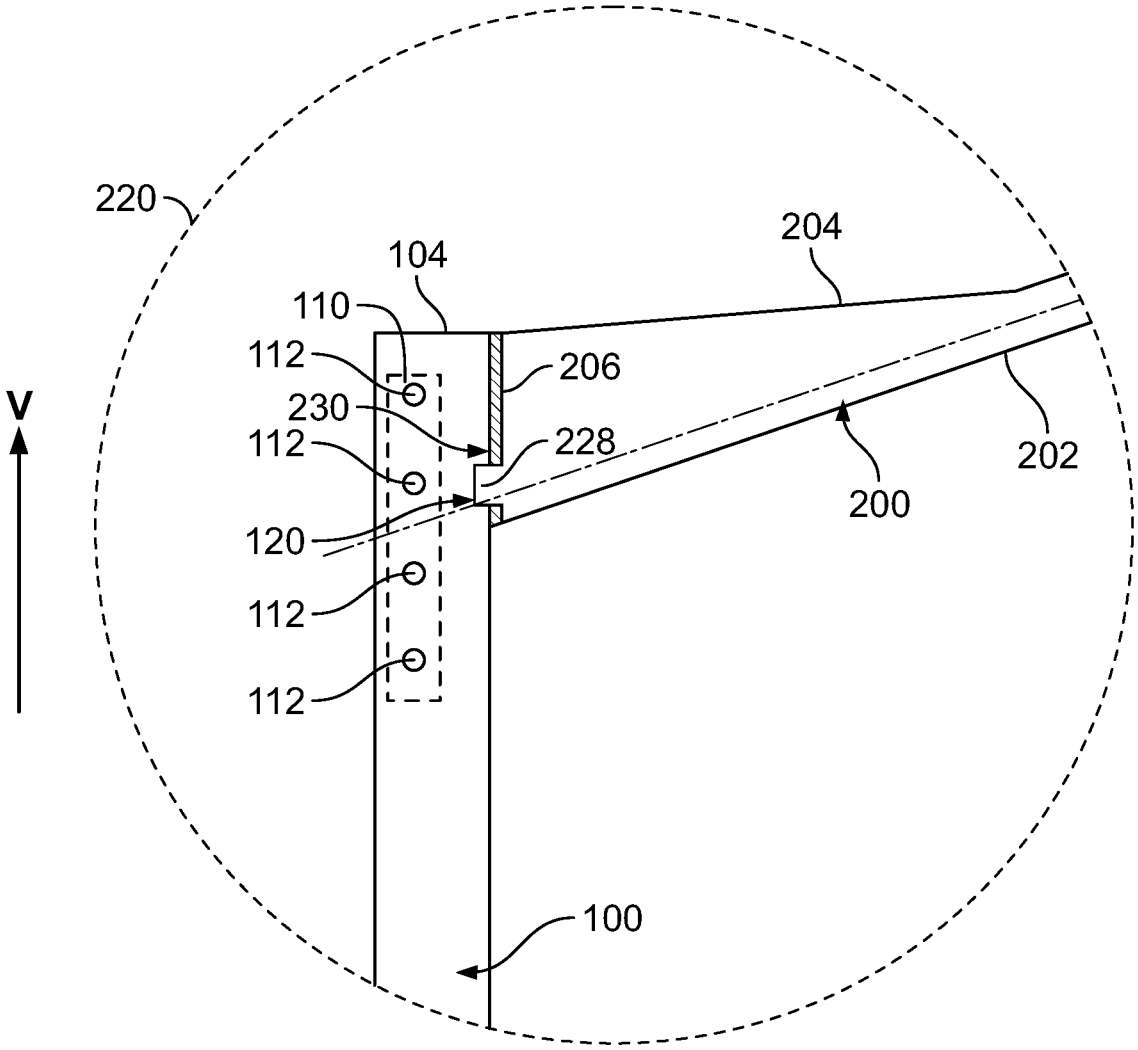
FIG. 4 is a detail sectional side view of a dome roof-to-wall connection detail of the concrete tank according to another embodiment.

Another embodiment of a connection between the dome roof 200 and the wall 100 is shown in the dome roof-to-wall connection detail 220 of FIG. 4. In the embodiment shown in FIG. 4, the perimeter 206 of the dome roof 200 is disposed on the wall 100 through an arrangement different than the embodiment shown in FIG. 3. Like reference numbers indicate like elements and primarily the differences from the embodiment shown in FIG. 3 will be described in detail with reference to the embodiment shown in FIG. 4.

In the embodiment shown in FIG. 4, the perimeter 206 of the dome roof 200 has a protrusion 228 extending from the perimeter 206. The wall 100 has a recess 120 formed in a portion of the wall 100 adjacent to the top end 104. The recess 120 receives the protrusion 228 of the dome roof 200. In the shown embodiment, an adhesive 230 is disposed between the perimeter 206 of the dome roof 200 and the wall 100 around the protrusion 228 and the recess 120 to secure the dome roof 200 to the wall 100.

In the embodiment shown in FIG. 4, the wall 100 has a tension ring 110 disposed within the wall 100 adjacent to the top end 104. The tension ring 110, in the shown embodiment, is formed from a plurality of wall reinforcement tendons 112 embedded within the wall 100; the wall reinforcement tendons 112 are precast within the concrete material of the wall 100. The wall reinforcement tendons 112 may be formed from a steel material, or may be formed from any other type of material used for reinforcing concrete.

In other embodiments, the tension ring 110 may be formed from any number of wall reinforcement tendons 112, and may include any number of other reinforcement elements used in concrete materials, such as reinforcement stirrups, provided that the tension ring 110 maintains a structure of the concrete tank 10 at the connection between the dome roof 200 and the wall 100. In other embodiments, the tension ring 110 can be disposed in other locations on the concrete tank 10, provided that the tension ring 110 maintains a structure of the concrete tank 10 at the connection between the dome roof 200 and the wall 100. The tension ring 110, for example, can be disposed outside of the wall 100 and the dome roof 200, and can bear on an external surface of the wall 100 or the dome roof 200.

As shown in FIG. 1, the dome roof 200 is at least partially cast in place according to one of the embodiments described above with an access opening 212 in the central section 210 extending through the dome roof 200 in the vertical direction V. The access opening 212 has a diameter 214 in a direction perpendicular to the vertical direction V. The access opening 212 is sized to allow the equipment 20 used to cast the dome roof 200 to fit through the access opening 212. In an embodiment, the diameter 214 of the access opening 212 is greater than 2 feet and, in another embodiment, is approximately 10 feet.

In the method of constructing the concrete tank 10, after the dome roof 200 is at least partially cast in place on the wall 100 according to one of the embodiments described above and cured, the equipment 20 is removed, for example lifted out, through the access opening 212. The position and size of the access opening 212 in the dome roof 200 allows the necessary equipment 20 to be removed from within the wall 100 and dome roof 200 without impairing a structural integrity of the concrete tank 10 by placing the opening in the wall 100.

The lid 300 is used to cover the access opening 212 once the equipment 20 has been removed from within the concrete tank 10. The lid 300, shown in FIG. 1, is formed of a precast concrete in an embodiment that is cast off site or otherwise not in its final position and shipped and/or moved to the position on the dome roof 200 shown in FIG. 1. In other embodiments, the lid 300 can be formed of a metal material or a fiberglass material. The lid 300 has an inner lid surface 302 and an outer lid surface 304 opposite the inner lid surface 302 in the vertical direction V. The lid 300 is a solid member in the shown embodiment; not having any holes or passageways extending through the lid 300. The size of the lid 300 required to cover the access opening 212 is sufficiently small that the lid 300 can be precast and shipped to the site in one piece.

A central section detail 216 labeled in FIG. 1 showing the central section 210 of the dome roof 200 and the lid 300 disposed to cover the access opening 212 will now be described in greater detail in various embodiments with reference to FIGS. 5-7.

Figure 5:
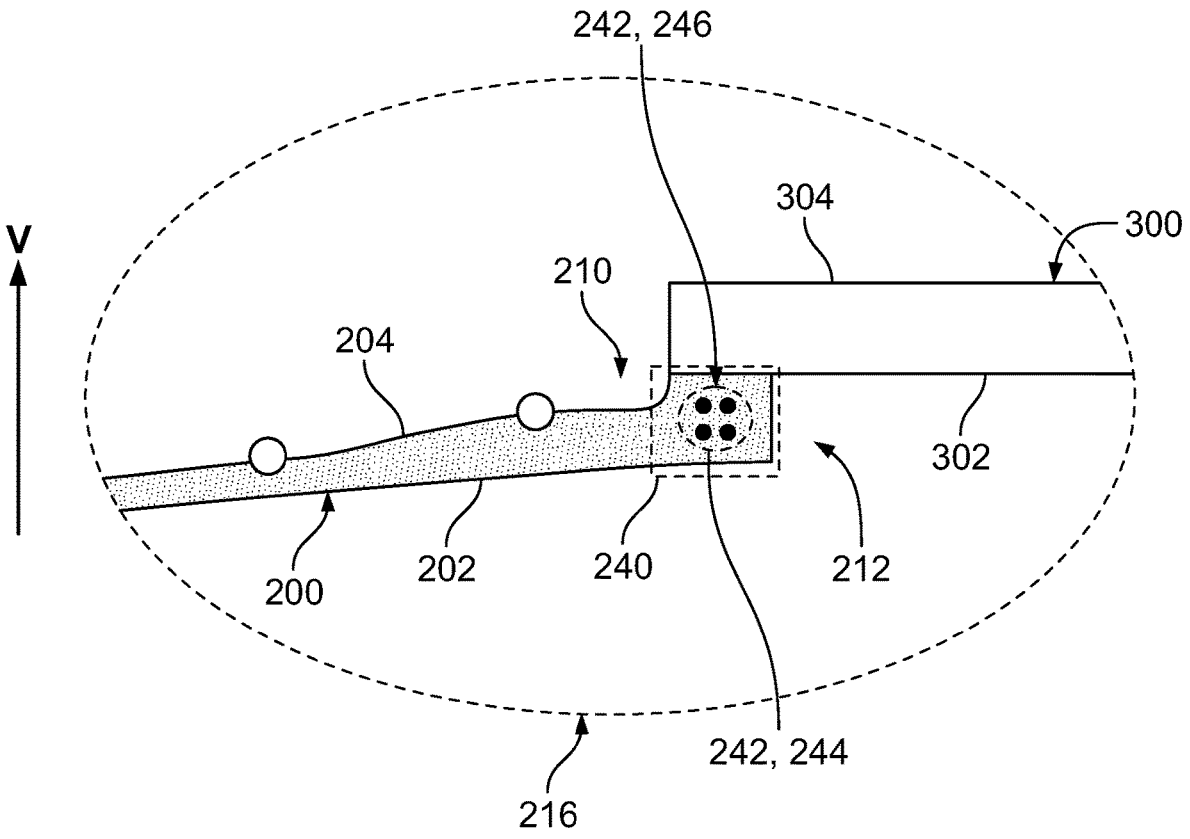
FIG. 5 is a detail sectional side view of a central section detail of the concrete tank.

An embodiment of the dome roof 200 in the central section 210 and the lid 300 on the central section 210 is shown in the central section detail 216 of FIG. 5. The dome roof 200 has a compression ring 240 in the central section 210 extending around the access opening 212. The compression ring 240 is formed by a plurality of reinforcement elements 242 embedded within the dome roof 200; the reinforcement elements 242 are set within the dome roof 200 while the concrete material of the dome roof 200 cures in place. The reinforcement elements 242 may be formed from a steel material, or may be formed from any type of material used for reinforcing concrete. In the shown embodiment, the reinforcement elements 242 include a plurality of compression reinforcement tendons 244 extending around the access opening 212 and a reinforcement stirrup 246 disposed around the compression reinforcement tendons 244. In other embodiments, the compression ring 240 may be formed from any number of compression reinforcement tendons 244 and reinforcement stirrups 246 and may include any number of other reinforcement elements 242 used in concrete materials, provided that the compression ring 240 maintains a structure of the dome roof 200 around the access opening 212. Although the compression ring 240 is only shown in FIG. 5, the compression ring 240 is likewise present in the embodiments in FIGS. 6 and 7 but has been omitted from these figures for clarity of the drawings.

In the embodiment shown in FIG. 5, the lid 300 is positioned over the access opening 212 with a portion of the inner lid surface 302 overlapping a portion of the outer dome roof surface 204 along the vertical direction V around the access opening 212. The portion of the inner lid surface 302 abuts the portion of the outer dome roof surface 204 around the access opening 212. The lid 300 is held in position covering the access opening 212 in the shown embodiment by a weight of the lid 300 and is removably positioned over the access opening 212.

Figure 6:
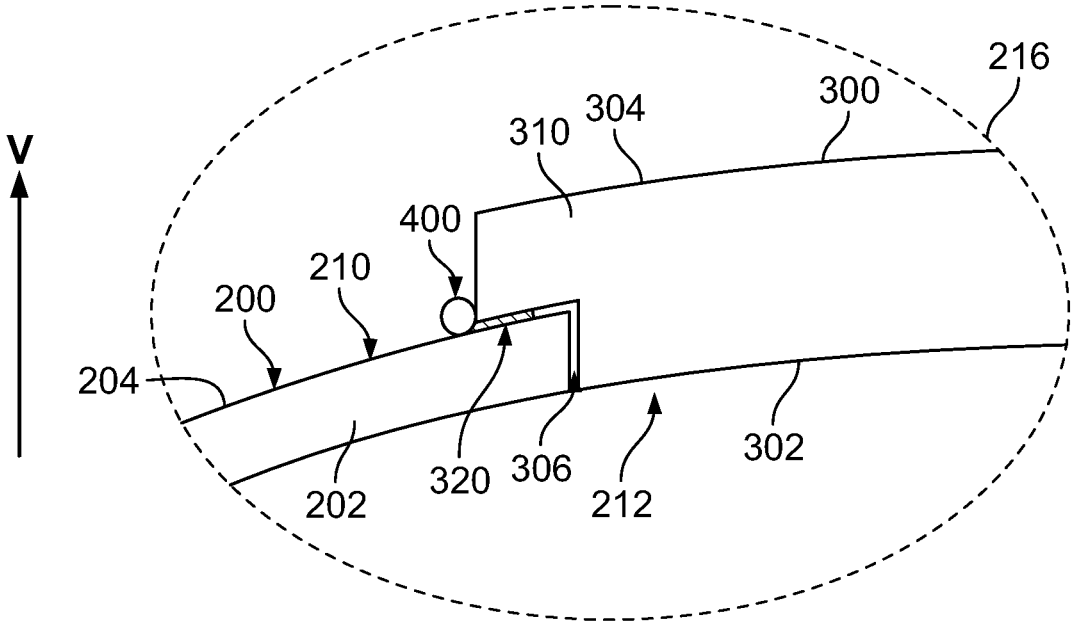
FIG. 6 is a detail sectional side view of a central section detail of the concrete tank according to another embodiment.

In another embodiment shown in FIG. 6, the lid 300 is positioned to cover the access opening 212 and is at least partially disposed within the access opening 212. The lid 300 in the embodiment of FIG. 6 has a flange 310 protruding from the lid 300. The portion of the inner lid surface 302 overlapping the portion of the outer dome roof surface 204 in the vertical direction V is disposed on the flange 310. The lid 300 and the flange 310 of the lid 300 form a seam 306 between the dome roof 200 and the lid 300 where the lid 300 meets the central section 210 of the dome roof 200 at the access opening 212. The inner lid surface 302 extends along the seam 306.

As shown in FIG. 6, a lid bearing element 320 is disposed between the inner lid surface 302 and the outer dome roof surface 204 along the vertical direction V; the lid bearing element 320 is disposed between the portion of the inner lid surface 302 and the overlapping portion of the outer dome roof surface 204. In the method of constructing the concrete tank 10, the lid bearing element 320 is positioned on the outer dome roof surface 204 prior to positioning the lid 300 over the access opening 212.

The lid bearing element 320, in an embodiment, is formed of a resilient elastomeric material, such as rubber or neoprene. In another embodiment, the lid bearing element 320 is formed of a resilient elastomeric material with fibers intermixed within the resilient elastomeric material, the fibers increasing a shear strength of the material. In another embodiment, the lid bearing element 320 can be formed of a rigid material, such as a hard plastic or grout. In the embodiment shown in FIG. 6, the lid bearing element 320 is held between the lid 300 and the central section 210 of the dome roof 200 by a weight of the lid 300.

In the embodiment shown in FIG. 6, a sealant 400 is disposed along the seam 306 where the seam 306 faces an area exterior of the concrete tank 10 to seal the seam 306. The sealant 400, in an embodiment, is a caulk. In other embodiments, the sealant 400 can be any type of element or material used to seal joints between concrete materials.

Figure 7:
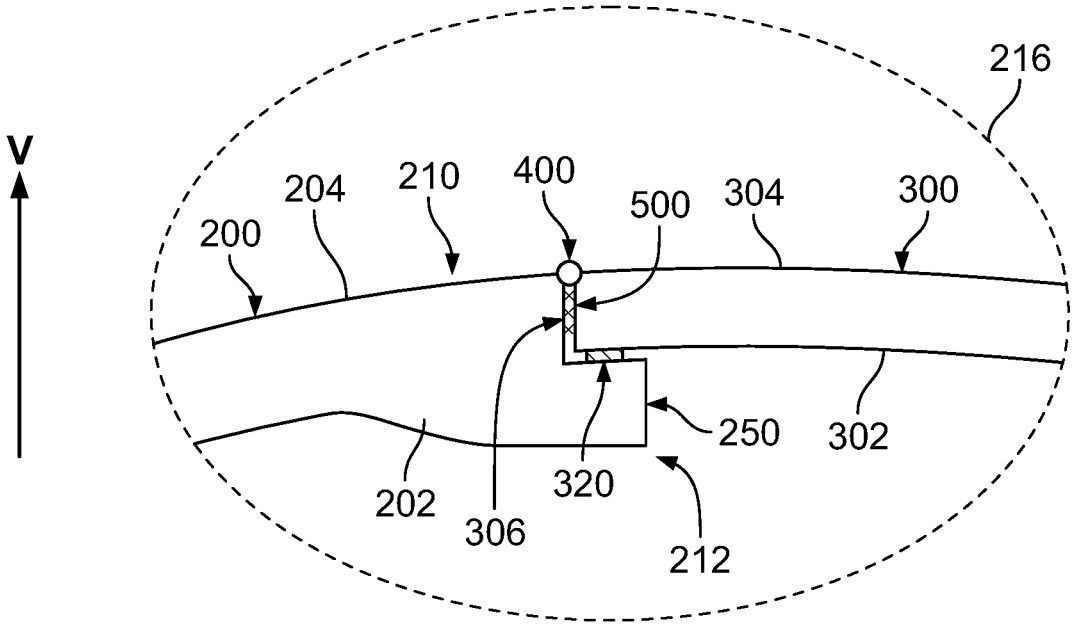
FIG. 7 is a detail sectional side view of a central section detail of the concrete tank according to another embodiment.

In another embodiment shown in FIG. 7, the lid 300 is positioned to cover the access opening 212 and is at least partially disposed within the access opening 212. The central section 210 of the dome roof 200 in the embodiment of FIG. 7 has a ledge 250 disposed around and extending into the access opening 212. The portion of the outer dome roof surface 204 overlapping the portion of the inner lid surface 302 in the vertical direction V is disposed on the ledge 250.

As shown in the embodiment of FIG. 7, the lid bearing element 320 is disposed between the inner lid surface 302 and the outer dome roof surface 204 along the vertical direction V; the lid bearing element 320 is disposed between the portion of the inner lid surface 302 and the overlapping portion of the outer dome roof surface 204. In the embodiment of FIG. 7, the lid bearing element 320 is held between the lid 300 and the central section 210 of the dome roof 200 by a weight of the lid 300.

In the embodiment shown in FIG. 7, the sealant 400 is disposed along the seam 306 where the seam 306 faces an area exterior of the concrete tank 10 to seal the seam 306. A grout 500 is disposed along the seam 306 adjacent to the sealant 400, between the sealant 400 and the lid bearing element 320. The grout 500 may be formed of any type of grout material used with concrete materials. In other embodiments, the grout 500 can be omitted.

In the embodiments shown in FIGS. 5-7, despite the optional presence of the sealant 400 and/or the grout 500 between the lid 300 and the dome roof 200, the lid 300 is still removable from the access opening 212. In other embodiments, the lid 300 could be directly attached to the dome roof 200 at the access opening 212, for example by casting the lid 300 positioned over and/or in the access opening 212 as shown in the embodiments of FIGS. 5-7 with an additional concrete material. The direct connection of the lid 300 to the dome roof 200 may be used, for example, in areas susceptible to earthquakes.

What is claimed is:

1. A concrete tank, comprising:

a dome roof formed of concrete at least partially cast in place, the dome roof having an access opening extending through the dome roof in a vertical direction;

a lid positioned to cover the access opening with a portion of an inner lid surface overlapping a portion of an outer dome roof surface along the vertical direction;

a lid bearing element disposed between the inner lid surface and the outer dome roof surface along the vertical direction; and a sealant disposed at a seam between the dome roof and the lid.

2. The concrete tank of claim 1, wherein the access opening is sized to allow an equipment used to cast the dome roof to fit through the access opening.

3. The concrete tank of claim 1, wherein the lid bearing element is formed of a resilient elastomeric material.

4. The concrete tank of claim 1, wherein the lid bearing element is formed of a rigid material.

5. The concrete tank of claim 1, further comprising a grout disposed along the seam between the sealant and the lid bearing element.

6. The concrete tank of claim 1, wherein the lid has a flange, the portion of the inner lid surface overlapping the portion of the outer dome roof surface is disposed on the flange.

7. The concrete tank of claim 1, wherein the dome roof has a ledge disposed around the access opening, the portion of the outer dome roof surface overlapping the portion of the inner lid surface is disposed on the ledge.

8. The concrete tank of claim 1, wherein the dome roof has a compression ring formed by a plurality of reinforcement elements disposed within the dome roof, the compression ring extends around the access opening.

9. The concrete tank of claim 1, further comprising a wall supporting the dome roof, the dome roof has a perimeter disposed on the wall and a central section within the perimeter, the access opening is disposed in the central section.

10. The concrete tank of claim 9, wherein the dome roof has a tension ring formed by a plurality of reinforcement tendons disposed within the dome roof at the perimeter.

11. The concrete tank of claim 9, wherein the wall has a tension ring formed by a plurality of reinforcement tendons disposed within a top end of the wall adjacent to the perimeter of the dome roof.

12. The concrete tank of claim 9, further comprising a dome roof bearing element disposed between the dome roof and the wall.

13. The concrete tank of claim 1, wherein the dome roof has a plurality of precast sections secured together by a plurality of closure strips that are cast in place.

14. The concrete tank of claim 13, wherein each of the precast sections has a concrete panel and a plurality of reinforcement elements protruding from the concrete panel, each of the closure strips secures and encloses the reinforcement elements of adjacent precast sections.

15. The concrete tank of claim 1, wherein the lid is removably positioned in the access opening.

16. A concrete tank, comprising:

a dome roof formed of concrete at least partially cast in place, the dome roof having an access opening extending through the dome roof in a vertical direction, the dome roof has a plurality of precast sections secured together by a plurality of closure strips that are cast in place;

a lid positioned to cover the access opening with a portion of an inner lid surface overlapping a portion of an outer dome roof surface along the vertical direction; and a lid bearing element disposed between the inner lid surface and the outer dome roof surface along the vertical direction.

17. The concrete tank of claim 16, wherein each of the precast sections has a concrete panel and a plurality of reinforcement elements protruding from the concrete panel, each of the closure strips secures and encloses the reinforcement elements of adjacent precast sections.

* * * * *